US009114900B2

(12) United States Patent
Hougland et al.

(10) Patent No.: US 9,114,900 B2
(45) Date of Patent: Aug. 25, 2015

(54) PAPER CUP SEAL

(75) Inventors: Dale P. Hougland, Florence, SC (US); Anthony R. Hafley, Visalia, CA (US); David C. Brown, Kingston, PA (US); Gregory M. Fike, Atlanta, GA (US)

(73) Assignee: Dixie Consumer Products LLC, Atlanta, GA (US)

( * ) Notice: Subject to any disclaimer, the term of this patent is extended or adjusted under 35 U.S.C. 154(b) by 237 days.

(21) Appl. No.: 13/215,593

(22) Filed: Aug. 23, 2011

(65) Prior Publication Data

US 2012/0048918 A1 Mar. 1, 2012

Related U.S. Application Data

(60) Provisional application No. 61/376,935, filed on Aug. 25, 2010.

(51) Int. Cl.
*B65D 3/14* (2006.01)

(52) U.S. Cl.
CPC ..... *B65D 3/14* (2013.01); *B31B 2217/062* (2013.01); *B31B 2217/082* (2013.01)

(58) Field of Classification Search
CPC ..... B65D 3/14
USPC ..... 229/400
See application file for complete search history.

(56) References Cited

U.S. PATENT DOCUMENTS

| | | | | |
|---|---|---|---|---|
| 2,633,894 | A * | 4/1953 | Carwile | 156/73.5 |
| 2,897,092 | A * | 7/1959 | Miller | 428/516 |
| 3,230,135 | A * | 1/1966 | Hurst | 428/342 |
| 3,243,934 | A * | 4/1966 | Kinney | 53/478 |
| 3,268,143 | A * | 8/1966 | Bolcato | 229/400 |
| 3,281,259 | A * | 10/1966 | Lux et al. | 427/557 |
| 3,675,015 | A * | 7/1972 | Geib | 250/302 |
| 4,452,596 | A | 6/1984 | Clauss et al. | |
| 4,629,477 | A | 12/1986 | Geke | |
| 4,685,591 | A | 8/1987 | Schaefer et al. | |
| 4,943,780 | A * | 7/1990 | Redding | 428/35.9 |
| 5,102,360 | A * | 4/1992 | Eycleshimer | 441/80 |
| 5,350,788 | A | 9/1994 | Visioli et al. | |
| 5,362,784 | A | 11/1994 | Brodie, III et al. | |

(Continued)

FOREIGN PATENT DOCUMENTS

| | | | |
|---|---|---|---|
| JP | 09-076375 | A | 3/1997 |
| JP | 2006-256643 | A | 9/2006 |

(Continued)

OTHER PUBLICATIONS

English translation of JP2008189342.*

(Continued)

*Primary Examiner* — Gary Elkins
*Assistant Examiner* — Scott McNurlen
(74) *Attorney, Agent, or Firm* — William Walter Letson

(57) ABSTRACT

A paper cup having a cup side wall bonded to a portion of a paper cup bottom wherein a seal promoter is present between at least a portion of the cup side wall and a portion of the cup bottom. At least a portion of the cup side wall and a portion of the cup bottom being coated with polyethylene such that the seal promoter is applied to a portion of at least one of the polyethylene coated surfaces. The present invention is also directed to a method of producing a cup having a seal promoter applied to an at least partially polyethylene treated cup side wall and/or cup bottom.

18 Claims, 2 Drawing Sheets

(56) References Cited

U.S. PATENT DOCUMENTS

| | | | | |
|---|---|---|---|---|
| 5,413,827 | A | 5/1995 | Brodie, III et al. | |
| 5,685,480 | A * | 11/1997 | Choi | 229/403 |
| 5,766,709 | A * | 6/1998 | Geddes et al. | 428/35.7 |
| 6,196,454 | B1 * | 3/2001 | Sadlier | 229/403 |
| 6,335,479 | B1 | 1/2002 | Yamada et al. | |
| 6,344,269 | B1 * | 2/2002 | Makar et al. | 428/349 |
| 6,465,726 | B2 | 10/2002 | Yamada et al. | |
| 6,720,097 | B2 * | 4/2004 | Ohkawa et al. | 428/701 |
| 6,777,610 | B2 | 8/2004 | Yamada et al. | |
| 6,866,949 | B2 | 3/2005 | Ota et al. | |
| 7,008,721 | B2 | 3/2006 | Yamashita et al. | |
| 7,101,921 | B2 | 9/2006 | Edwards et al. | |
| 7,279,061 | B2 | 10/2007 | Francois | |
| 7,285,334 | B1 | 10/2007 | Yamashita et al. | |
| 7,309,831 | B2 | 12/2007 | Yamada et al. | |
| 7,399,350 | B2 | 7/2008 | Rajaraman et al. | |
| 8,074,638 | B2 * | 12/2011 | Cummings | 126/684 |
| 2004/0209023 | A1 * | 10/2004 | Swoboda et al. | 428/34.2 |
| 2005/0029337 | A1 * | 2/2005 | Van Handel | 229/403 |
| 2006/0009338 | A1 * | 1/2006 | Kirkpatrick et al. | 493/104 |
| 2006/0057365 | A1 * | 3/2006 | Swoboda et al. | 428/323 |
| 2006/0135668 | A1 * | 6/2006 | Hayes | 524/430 |
| 2006/0246263 | A1 | 11/2006 | Yahiaoui et al. | |
| 2008/0156857 | A1 * | 7/2008 | Johnston | 229/100 |

FOREIGN PATENT DOCUMENTS

| | | | |
|---|---|---|---|
| JP | 2008-189342 | A | 8/2008 |
| KR | 10-2003-0086313 | A | 11/2003 |
| WO | 03066512 | A1 | 8/2003 |
| WO | 2009097166 | A1 | 8/2009 |
| WO | 2010109000 | A2 | 9/2010 |

OTHER PUBLICATIONS

International Search Report and Written Opinion of the International Search Authority for PCT/US2011/048767 mailed Mar. 21, 2012.

European Patent Office, Extended European Search Report for Application No. 11820503.8, Jun. 19, 2015, seven pages, Munich, Germany.

Richard M. Podhajny, "Focus on Crosslinking in Fluid Ink Systems—Paper, Film & Foil Converter", Jun. 1, 2002, two pages, http://pffc-online.com/print/inks/584-paper-focus-crosslinking-fluid.

* cited by examiner

PAPER CUP SEAL

CROSS-REFERENCE TO RELATED APPLICATION

This application claims priority to U.S. Patent Application No. 61/376,935, filed on Aug. 25, 2010, the entirety of which is incorporated herein by reference.

FIELD OF THE INVENTION

This invention pertains to the manufacture of paper cups and, more specifically, to sealing between bonded surfaces of such cups.

BACKGROUND OF THE INVENTION

Manufacture of paper cups begins with rolls of paperboard stock. Generally, the stock is first coated with polyethylene on at least the surfaces that will be the inside cup surfaces (in the case of a cup for hot liquids) and on both inside and outside surfaces of cups intended for cold liquids. The outside of cold cups needs to be coated because condensation that forms on the outside of a cup holding a cold beverage or other liquid can soak into the paperboard of a cup not coated on the outside. The polyethylene coated stock is then printed with any printing to appear on the finished cup.

After coating and printing, the printed paperboard stock is die cut into flats that will become the cup wall. Each flat is then wound around a tapered mandrel to form the cup wall, and overlapping wall edges are bonded with heat and pressure.

Disks for bottoms are die cut from typically unprinted paperboard stock, and a disk is pressed into the smaller diameter of each cup wall and sealed in place with heat and pressure. Finally, the upper edge of the cup is rolled into a lip.

The bonds between overlapping edges of the cup wall are formed between a polyethylene coated surface and an uncoated surface in the case of a typical hot cup and between two coated surfaces in the case of a cold cup. At least a portion of the bond between the cup bottom and the cup wall are formed between surfaces coated with polyethylene in all paper cups, and the entire bottom bond in a cold cup is between two coated surfaces. These bonds are typically adequate to avoid leaks in smaller, shorter cups.

However, the liquid pressure at the bottom of a tall cup becomes significant when full, with the result that leaks sometimes develop where the cup bottom is bonded to the sidewall. Leaks may also develop where difficult shapes have been bonded.

SUMMARY OF THE INVENTION

Integrity of bonds between polyethylene-coated board stock surfaces may be improved by coating one or more of those surfaces with seal promoter prior to the application of heat and pressure to bond the two polyethylene-coated surfaces. Seal promoter has been used in the past to enhance the bond between a polyethylene-coated surface and an uncoated board stock surface, but it was unexpected that application of seal promoter would improve the bond between two polyethylene coated paperboard surfaces.

Seal promoters suitable for practicing this invention include Lupasol® PS polyethylenimine sold by BASF Corporation, 3000 Continental Drive-North, Mount Olive, N.J. 07828-1234, and other suitable polyethylenimines.

Added expense resulting from use of seal promoter has limited its use, and, notwithstanding prior use of polyethylenimine seal promoter to improve the bond between a polyethylene coated paperboard surface and an uncoated paperboard surface, the ability of seal promoter to improve the seal between two polyethylene-coated surfaces in this invention is surprising. That is, it is Applicants' belief the polyethylenimine seal promoter has molecules having a polar end and a non-polar end and further that the polar end of the polyethylenimine molecules is attracted to the uncoated paperboard cup component and that the non-polar end of the molecules is attracted and bonds to the polyethylene coating on the coated cup component. It is therefore surprising that polyethylenimine seal promoter improves the seal or bond between two polyethylene coated surfaces, since both polyethylene coated surfaces presumably have the same polarity or the same affinity for a particular non-polar end of a molecule. Whereas, the cup side wall component is subjected to post-treatment (e.g., flame or corona treatment—to oxidize the cup side wall component) after the polyethylene is applied to the uncoated paper board, and the cup bottom component is not subjected to the post-treatment step, it is thought that post treating the coated cup component may have an effect on the polarity of the poly coated cup side wall component, with the result that the polar end of the polyethylenimine seal promoter molecules experiences an increased attraction to the post-treated polyethylene coating on the coated cup component, and the non-polar end of the polyethylenimine seal promoter molecules is attracted to the non-post-treated coated bottom cup component. Accurate and complete understanding of the way in which this invention works is not necessary to practice the invention, and Applicants do not want to be bound by the forgoing or any other understanding of how their invention or any of the prior art works.

DETAILED DESCRIPTION

Figure 1:
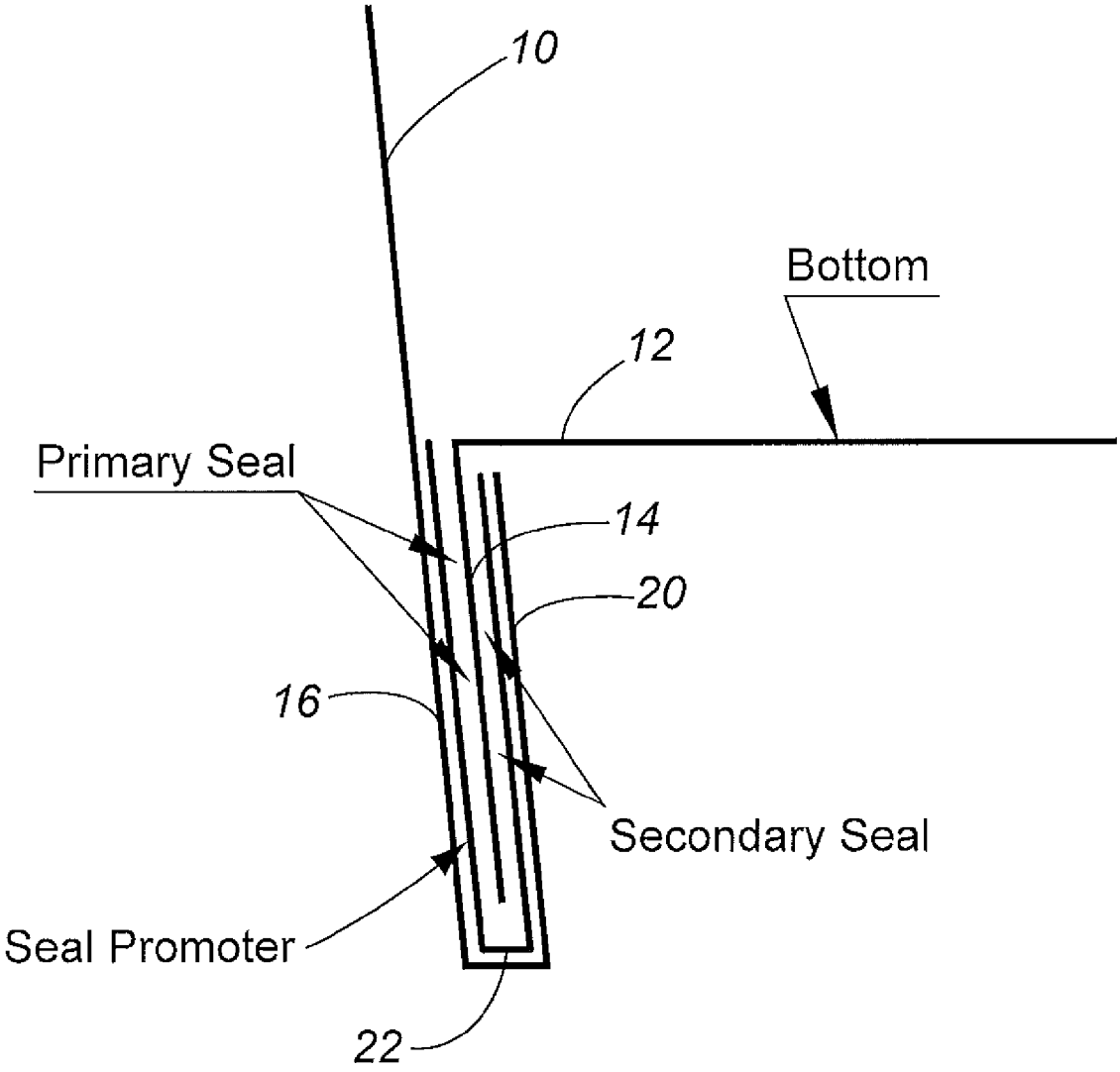
FIG. 1 is a schematic cross section of a portion of one embodiment of a paper cup of this invention taken through the cup wall and cup bottom.
Figure 2:
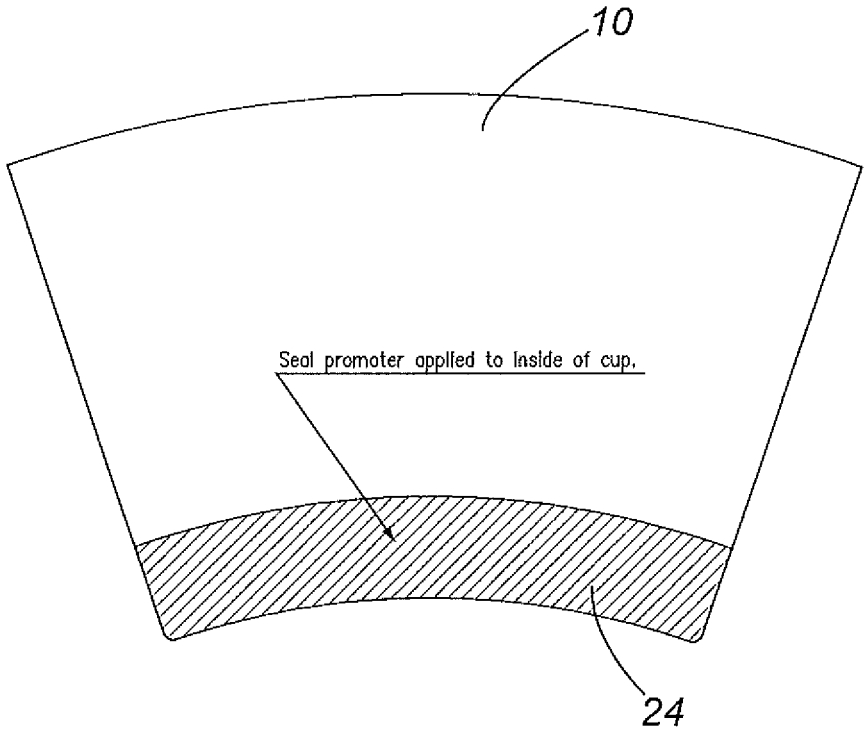
FIG. 2 is a plan view of a cup wall flat showing application of seal promoter in accordance with an embodiment of this invention along the lower cup wall edge.
Figure 3:
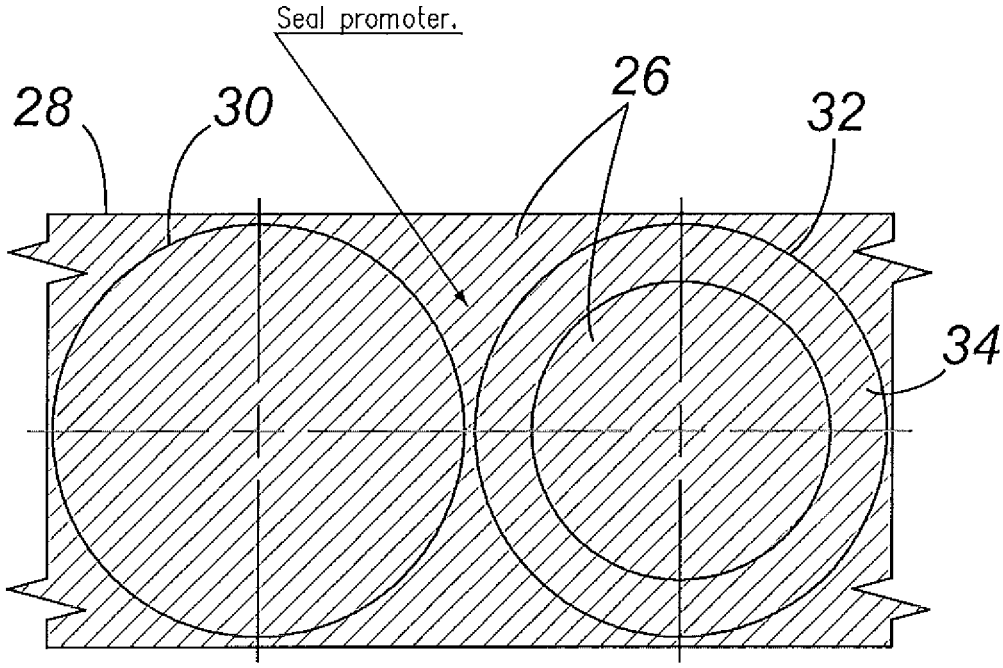
FIG. 3 is a portion of a paperboard web entirely coated on at least one side of the web and showing the die cut lines that would separate two bottoms from the web and, in the right bottom, an inner circle indicating where the cup bottom would bend down as it is inserted into a cup wall.

As is illustrated in FIG. 1 below depicting a cross section though a paper cup wall 10 and bottom 12, a depending skirt 14 is formed around the circular bottom, and that skirt is bonded between a portion 16 of the cup wall 10 and an adjacent upturned portion 20 of the lower cup wall. Seal promoter 22 may be applied between these bonded surfaces of cup wall 10 portion 16, skirt 14 of bottom 12, and cup wall 10 portion 20, by applying the seal promoter 22 to the portion of the flat cup wall 10 that will become the lower inside edge 24 of the cup wall, as illustrated in FIG. 2. In an alternate embodiment, seal promoter 22 can be applied to all (as illustrated in FIG. 3) or a portion of the top surface 26 of the cup bottom paperboard strip or web 28. In another embodiment seal promoter 22 can be applied to the bottom facing surface of cup bottom paperboard web 28.

Application of seal promoter 22 to the entire top and bottom surfaces of cup bottom web 28 will result in application of seal promoter 22 to the entire cup bottom 30 that may be cut from web 28, as illustrated in FIG. 3. Cup bottom 32 also shown in FIG. 3 is marked to identify the annular portion 34 that will contact cup wall 10 when bottom 32 is attached to cup wall 10. Seal promoter 22 may be applied only to this annular portion 34. However, if seal promoter 22 is not applied to cup wall 10, seal promoter 22 should be applied to both sides of annular portion 34 of cup bottom 32 if it is desired that seal promoter 22 be present between both of (a) cup wall portion 16 and cup bottom 12 and (b) cup wall portion 20 and cup bottom 12. Seal promoter 22 can also be applied to both of cup wall 10 and bottom 12. It will be appreciated that the seal promoter may be applied between any treated poly surface and any untreated poly surface. Without wishing to limit the scope of the invention, it is believed that the treatment, desirably flame or corona treatment to oxidize at least a portion of the polyethylene, changes the polar surface energy to promote better sealing when combined with a seal promoter such as polyethylenimine.

The post treatment step (e.g., treatment to change the polar surface energy) should be done to at least a portion of the polyethylene of the side wall and/or the bottom. The step of applying a post-treatment generally occurs prior to applying the seal promoter. In at least some embodiments the post treatment is an oxidizing step, and at least a portion of the polyethylene is oxidized, desirably by flame or corona treatment.

Seal promoter can be applied to a cup component that receives it by any appropriate application process, including, among others, brushing, spraying, printing and wicking. Printing can be done through the use of a dedicated plate or by simply substituting the seam sealer for one of the inks in a multi-color printer (which typically accommodate up to six colors).

In addition to its use to bond the cup wall to a cup bottom, seal promoter may be applied to at least one of two polyethylene coated surfaces to be bonded to each other on a cup side seam.

The polyethylenimine seal promoter is typically clear when dry, so it may be difficult or impossible to see after printing or otherwise coating or applying it to a cup component. Accordingly, it may be desirable to add a food coloring or other safe coloring agent or colorant in order to make the polyethylenimine seal promoter visible if that is desirable for production or other reasons.

Numerous modifications of this invention may be made in the composition, application, manufacturing process and other aspects of this invention without departing from the spirit of the description above and in the Figures or the scope of the following claims.

The invention claimed is:

1. A heat sealed paper cup comprising:

a. a cup side wall comprising a peripheral portion that comprises a polyethylene coating that is non-polar and a cup bottom comprising a polyethylene coating that is also non-polar, wherein the cup bottom is heat sealed to the cup side wall with heat and pressure so that molecules of the polyethylene coating of the cup side wall bind to molecules of the polyethylene coating of the cup bottom to form a primary bond between the two polyethylene coatings; and b. polyethylenimine seal promoter between the non-polar polyethylene coated cup side wall and the non-polar polyethylene coated cup bottom that strengthens the primary bond between the molecules of the two polyethylene coatings.

2. The cup of claim 1, wherein at least a portion of the polyethylene is oxidized.

3. The cup of claim 1, wherein at least a portion of the polyethylene is flame or corona treated.

4. The cup of claim 1, wherein the seal promoter is applied to the cup side wall peripheral portion before the side wall is bonded to the bottom.

5. The cup of claim 1, wherein the seal promoter is applied to the bottom peripheral portion before the side wall is bonded to the bottom.

6. The cup of claim 1, wherein the seal promoter further comprised colorant.

7. A method for producing a cup, comprising:

a. coating at least a portion of a paperboard blank for a cup side wall with polyethylene, b. coating at least a portion of a paperboard cup bottom with polyethylene, c. applying polyethylenimine seal promoter to at least one of the coated portion of the cup side wall and the coated portion of the paperboard cup bottom, and d. heat sealing the bottom to the side wall along the seal promoter with heat and pressure such that molecules of the polyethylene of the paperboard blank for the cup side wall adhere to molecules of the polyethylene of the paperboard cup bottom to form a primary bond between the two polyethylene coatings, wherein the seal promoter strengthens the primary bond between the molecules of the two polyethylene coatings.

8. The method of claim 7, further comprising applying the polyethylenimine seal promoter to the portion of the cup side wall.

9. The method of claim 7, further comprising applying the polyethylenimine seal promoter to the cup bottom.

10. The method of claim 7, wherein the polyethylenimine seal promoter is applied by printing it onto the at least one of the cup side or the cup bottom.

11. The method of claim 7, wherein the polyethylenimine seal promoter is applied by spraying it onto the at least one of the cup side or the cup bottom.

12. The method of claim 7, wherein the polyethylenimine seal promoter further comprises colorant.

13. The method of claim 7, further comprising applying a post treatment to at least a portion of the polyethylene of the side wall and/or the bottom.

14. The method of claim 13, wherein the step of applying a post-treatment occurs prior to applying the polyethylenimine seal promoter.

15. The method of claim 14, wherein the post treatment is an oxidizing step.

16. The method of claim 13, wherein at least a portion of the polyethylene is oxidized.

17. The method of claim 13, wherein at least a portion of the polyethylene is flame or corona treated.

18. A heat sealed paper cup comprising:

a. a cup side wall comprising a portion coated with a first coating;

b. a bottom comprising a portion coated with a second coating, wherein the bottom is heat sealed to the cup side wall with heat and pressure such that molecules of the first coating bind to molecules of the second coating to form a primary bond between the first coating and the second coating, wherein the first coating and the second coating have the same polarity; and c. a polyethylenimine seal promoter applied between the first coating and the second coating to strengthen the primary bond between the molecules of the first and second coatings.

* * * * *